US008136590B2

(12) United States Patent
Hsu

(10) Patent No.: US 8,136,590 B2
(45) **Date of Patent: *Mar. 20, 2012**

(54) SYSTEMS AND METHODS FOR PRODUCING OIL AND/OR GAS

(75) Inventor: Chia-Fu Hsu, Rijswijk (NL)

(73) Assignee: Shell Oil Company, Houston, TX (US)

( * ) Notice: Subject to any disclaimer, the term of this patent is extended or adjusted under 35 U.S.C. 154(b) by 8 days.

This patent is subject to a terminal disclaimer.

(21) Appl. No.: 11/749,915

(22) Filed: May 17, 2007

(65) Prior Publication Data

US 2008/0023198 A1 Jan. 31, 2008

Related U.S. Application Data

(60) Provisional application No. 60/747,908, filed on May 22, 2006.

(51) Int. Cl.
*E21B 43/16* (2006.01)
*E21B 43/00* (2006.01)
*E21B 43/30* (2006.01)

(52) U.S. Cl. ..... 166/245; 166/52; 166/268; 166/400; 166/401

(58) Field of Classification Search ..... 166/266, 166/268, 403

See application file for complete search history.

(56) References Cited

U.S. PATENT DOCUMENTS

| | | | | |
|---|---|---|---|---|
| 2,330,934 A | | 10/1943 | Thacker | 23/206 |
| 2,492,719 A | | 12/1949 | Thacker | 23/206 |
| 2,636,810 A | | 4/1953 | Marisic | 23/206 |
| 2,670,801 A | | 3/1954 | Sherborne | 166/21 |
| 3,087,788 A | | 4/1963 | Porter | 23/181 |
| 3,345,135 A | | 10/1967 | Kerr et al. | 23/206 |
| 3,366,452 A | | 1/1968 | Wynne | 23/204 |
| 3,387,888 A | * | 6/1968 | Shock et. al. | 299/4 |
| 3,393,733 A | | 7/1968 | Kuo et al. | 166/8 |
| 3,402,768 A | | 9/1968 | Felsenthal et al. | |
| 3,481,399 A | * | 12/1969 | Hujsak | 166/259 |
| 3,498,378 A | | 3/1970 | Stone et al. | 166/263 |
| 3,512,585 A | * | 5/1970 | Allen | 166/245 |
| 3,581,821 A | | 6/1971 | Ross | 166/245 |
| 3,647,906 A | | 3/1972 | Farley | 260/683 D |
| 3,672,448 A | | 6/1972 | Hoyt | 166/245 |
| 3,724,553 A | | 4/1973 | Snavely, Jr. et al. | 166/304 |

(Continued)

FOREIGN PATENT DOCUMENTS

EP 0581026 A1 2/1994

(Continued)

OTHER PUBLICATIONS

PCT/US2007/069225, International Search Report dated Oct. 18, 2007.

*Primary Examiner* — Angela M DiTrani

(57) ABSTRACT

A system for producing oil and/or gas from an underground formation comprising a first array of wells dispersed above the formation; a second array of wells dispersed above the formation; wherein the first array of wells comprises a mechanism to inject a miscible enhanced oil recovery formulation into the formation while the second array of wells comprises a mechanism to produce oil and/or gas from the formation for a first time period; and wherein the second array of wells comprises a mechanism to inject a miscible enhanced oil recovery formulation into the formation while the first array of wells comprises a mechanism to produce oil and/or gas from the formation for a second time period.

16 Claims, 8 Drawing Sheets

U.S. PATENT DOCUMENTS

| | | | | | |
|---|---|---|---|---|---|
| 3,729,053 | A | | 4/1973 | Froning | 166/304 |
| 3,754,598 | A | | 8/1973 | Holloway, Jr. | 166/249 |
| 3,794,114 | A | | 2/1974 | Brandon | 166/249 |
| 3,805,892 | A | | 4/1974 | Haynes, Jr. | 166/245 |
| 3,822,748 | A | * | 7/1974 | Allen et al. | 166/269 |
| 3,823,777 | A | | 7/1974 | Allen et al. | 166/266 |
| 3,840,073 | A | | 10/1974 | Allen et al. | 166/274 |
| 3,847,221 | A | | 11/1974 | Allen et al. | 166/274 |
| 3,850,245 | A | | 11/1974 | Allen et al. | 166/274 |
| 3,878,892 | A | | 4/1975 | Allen et al. | 166/267 |
| 3,908,762 | A | * | 9/1975 | Redford | 166/402 |
| 3,913,672 | A | * | 10/1975 | Allen et al. | 166/402 |
| 3,927,185 | A | | 12/1975 | Meadow et al. | 423/443 |
| 4,008,764 | A | | 2/1977 | Allen | 166/266 |
| 4,057,613 | A | | 11/1977 | Meadow et al. | 423/443 |
| 4,122,156 | A | | 10/1978 | Kittrell et al. | 423/443 |
| 4,182,416 | A | | 1/1980 | Trantham et al. | 166/245 |
| 4,305,463 | A | | 12/1981 | Zakiewicz | 106/245 |
| 4,393,937 | A | | 7/1983 | Dilgren et al. | 166/272 |
| 4,476,113 | A | | 10/1984 | Young et al. | 424/161 |
| 4,488,976 | A | | 12/1984 | Dilgren et al. | 252/8.55 D |
| 4,512,400 | A | * | 4/1985 | Simon | 166/245 |
| 4,543,434 | A | | 9/1985 | Chang | 585/310 |
| 4,550,779 | A | | 11/1985 | Zakiewicz | 166/248 |
| 4,744,417 | A | * | 5/1988 | Alameddine | 166/245 |
| 4,822,938 | A | | 4/1989 | Audeh et al. | 585/324 |
| 4,963,340 | A | | 10/1990 | Audeh et al. | 423/444 |
| 5,065,821 | A | | 11/1991 | Huang et al. | 166/245 |
| 5,076,358 | A | | 12/1991 | Kissel | 166/275 |
| 5,120,935 | A | | 6/1992 | Nenniger | 392/305 |
| 5,607,016 | A | | 3/1997 | Butler | 166/263 |
| 5,609,845 | A | | 3/1997 | Cimini et al. | 423/648.1 |
| 5,803,171 | A | | 9/1998 | McCaffery et al. | 166/245 |
| 5,826,656 | A | | 10/1998 | McGuire et al. | 166/305.1 |
| 6,136,282 | A | | 10/2000 | Fisher | 423/220 |
| 6,149,344 | A | | 11/2000 | Eaton | 405/128 |
| 6,241,019 | B1 | | 6/2001 | Davidson et al. | 166/249 |
| 6,405,797 | B2 | | 6/2002 | Davidson et al. | 166/249 |
| 6,497,855 | B1 | | 12/2002 | Wachs | 423/648.1 |
| 6,506,349 | B1 | | 1/2003 | Khanmamedov | 423/210 |
| 6,706,108 | B2 | | 3/2004 | Polston | 106/285 |
| 6,811,683 | B2 | * | 11/2004 | Davis et al. | 208/97 |
| 6,851,473 | B2 | | 2/2005 | Davidson | 166/263 |
| 2001/0008619 | A1 | | 7/2001 | Geus et al. | 423/230 |
| 2002/0134706 | A1 | | 9/2002 | Keller et al. | 208/250 |
| 2003/0047309 | A1 | | 3/2003 | Thomas et al. | 166/265 |
| 2003/0194366 | A1 | | 10/2003 | Srinivas et al. | 423/230 |
| 2004/0022721 | A1 | | 2/2004 | Watson et al. | 423/574.1 |
| 2004/0096381 | A1 | | 5/2004 | Watson et al. | 423/224 |
| 2004/0146288 | A1 | | 7/2004 | Vinegar et al. | 392/301 |
| 2004/0146450 | A1 | | 7/2004 | Stauffer | 423/443 |
| 2004/0159583 | A1 | | 8/2004 | Mesters et al. | 208/208 |
| 2004/0189108 | A1 | | 9/2004 | Dooley | 310/52 |
| 2004/0256097 | A1 | | 12/2004 | Byrd et al. | 166/90.1 |
| 2006/0254769 | A1 | | 11/2006 | Wang et al. | 166/266 |
| 2007/0251686 | A1 | | 11/2007 | Sivrikoz et al. | 166/249 |
| 2008/0023198 | A1 | | 1/2008 | Hsu | 166/268 |
| 2008/0087425 | A1 | | 4/2008 | Hsu et al. | 166/266 |

FOREIGN PATENT DOCUMENTS

| | | | |
|---|---|---|---|
| GB | 1007674 | | 10/1965 |
| GB | 1173344 | | 12/1969 |
| GB | 2379685 | A | 3/2003 |
| WO | WO9850679 | | 11/1998 |
| WO | WO2007131976 | A1 | 11/2007 |
| WO | WO2007131977 | A1 | 11/2007 |
| WO | WO2008003732 | A1 | 1/2008 |
| WO | WO2008034777 | A1 | 3/2008 |

* cited by examiner

- Prior Art -

SYSTEMS AND METHODS FOR PRODUCING OIL AND/OR GAS

RELATED APPLICATIONS

The present application claims priority to co-pending U.S. Application 60/747,908, filed May 22, 2006. U.S. Application 60/747,908 is herein incorporated by reference in its entirety.

FIELD OF THE INVENTION

The present disclosure relates to systems and methods for producing oil and/or gas.

BACKGROUND OF THE INVENTION

Enhanced Oil Recovery (EOR) may be used to increase oil recovery in fields worldwide. There are three main types of EOR, thermal, chemical/polymer and gas injection, which may be used to increase oil recovery from a reservoir, beyond what can be achieved by conventional means—possibly extending the life of a field and boosting the oil recovery factor.

Thermal enhanced recovery works by adding heat to the reservoir. The most widely practiced form is a steamdrive, which reduces oil viscosity so that it can flow to the producing wells. Chemical flooding increases recovery by reducing the capillary forces that trap residual oil. Polymer flooding improves the sweep efficiency of injected water. Miscible injection works in a similar way to chemical flooding. By injecting a fluid that is miscible with the oil, trapped residual oil can be recovered.

Referring to FIG. 1, there is illustrated prior art system 100. System 100 includes underground formation 102, underground formation 104, underground formation 106, and underground formation 108. Production facility 110 is provided at the surface. Well 112 traverses formations 102 and 104, and terminates in formation 106. The portion of formation 106 is shown at 114. Oil and gas are produced from formation 106 through well 112, to production facility 110. Gas and liquid are separated from each other, gas is stored in gas storage 116 and liquid is stored in liquid storage 118.

U.S. Pat. No. 5,826,656 discloses a method for recovering waterflood residual oil from a waterflooded oil-bearing subterranean formation penetrated from an earth surface by at least one well by injecting an oil miscible solvent into a waterflood residual oil-bearing lower portion of the oil-bearing subterranean formation through a well completed for injection of the oil miscible solvent into the lower portion of the oil-bearing formation; continuing the injection of the oil miscible solvent into the lower portion of the oil-bearing formation for a period of time equal to at least one week; recompleting the well for production of quantities of the oil miscible solvent and quantities of waterflood residual oil from an upper portion of the oil-bearing formation; and producing quantities of the oil miscible solvent and waterflood residual oil from the upper portion of the oil-bearing formation. The formation may have previously been both waterflooded and oil miscible solvent flooded. The solvent may be injected through a horizontal well and solvent and oil may be recovered through a plurality of wells completed to produce oil and solvent from the upper portion of the oil-bearing formation. U.S. Pat. No. 5,826,656 is herein incorporated by reference in its entirety.

Co-pending U.S. Patent Application Publication Number 2006/0254769, published Nov. 16, 2006, discloses a system including a mechanism for recovering oil and/or gas from an underground formation, the oil and/or gas comprising one or more sulfur compounds; a mechanism for converting at least a portion of the sulfur compounds from the recovered oil and/or gas into a carbon disulfide formulation; and a mechanism for releasing at least a portion of the carbon disulfide formulation into a formation. U.S. Patent Application Publication Number 2006/0254769 is herein incorporated by reference in its entirety.

There is a need in the art for improved systems and methods for enhanced oil recovery. There is a further need in the art for improved systems and methods for enhanced oil recovery using a solvent, for example through viscosity reduction, chemical effects, and miscible flooding. There is a further need in the art for improved systems and methods for solvent miscible flooding.

SUMMARY OF THE INVENTION

In one aspect, the invention provides a system for producing oil and/or gas from an underground formation comprising a first array of wells dispersed above the formation; a second array of wells dispersed above the formation; wherein the first array of wells comprises a mechanism to inject a miscible enhanced oil recovery formulation into the formation while the second array of wells comprises a mechanism to produce oil and/or gas from the formation for a first time period; and wherein the second array of wells comprises a mechanism to inject a miscible enhanced oil recovery formulation into the formation while the first array of wells comprises a mechanism to produce oil and/or gas from the formation for a second time period.

In another aspect, the invention provides a method for producing oil and/or gas comprising injecting a carbon disulfide formulation into a formation for a first time period from a first well; and then injecting an immiscible enhanced oil recovery formulation into the formation for a second time period from the first well, to push the carbon disulfide formulation through the formation; and producing oil and/or gas from the formation from a second well.

In another aspect, the invention provides a method for producing oil and/or gas comprising injecting a miscible enhanced oil recovery formulation into a formation for a first time period from a first well; producing oil and/or gas from the formation from a second well for the first time period; injecting a miscible enhanced oil recovery formulation into a formation for a second time period from the second well; and producing oil and/or gas from the formation from the first well for the second time period.

Advantages of the invention include one or more of the following:

Improved systems and methods for enhanced recovery of hydrocarbons from a formation with a solvent.

Improved systems and methods for enhanced recovery of hydrocarbons from a formation with a fluid containing a miscible solvent.

Improved compositions and/or techniques for secondary recovery of hydrocarbons.

Improved systems and methods for enhanced oil recovery.

Improved systems and methods for enhanced oil recovery using a miscible solvent.

Improved systems and methods for enhanced oil recovery using a compound which is miscible with oil in place.

DETAILED DESCRIPTION OF THE INVENTION

Figure 1:
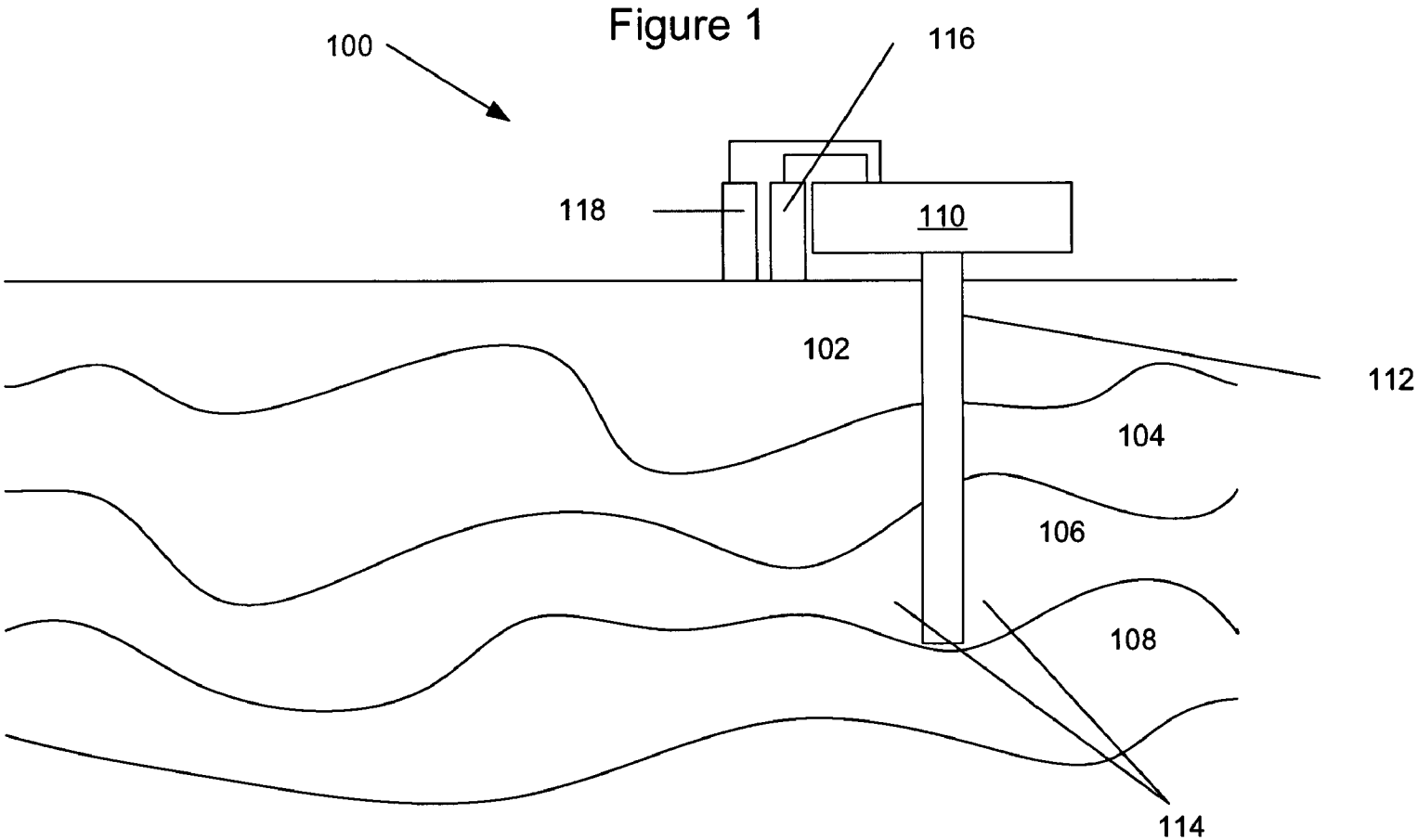
FIG. 1 illustrates an oil and/or gas production system.
Figure 2A:
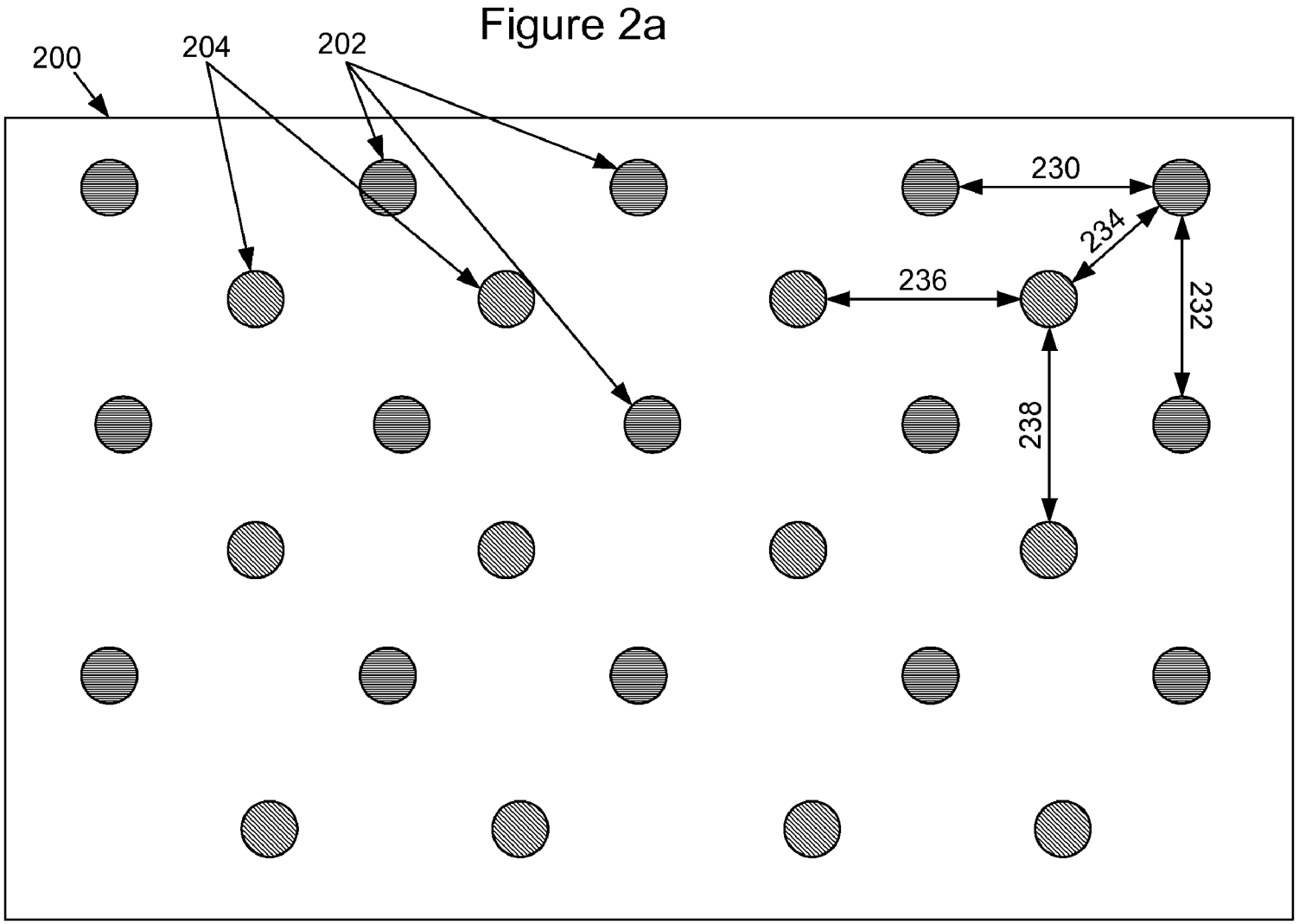
FIG. 2*a* illustrates a well pattern.

Referring now to FIG. 2*a*, in some embodiments, an array of wells 200 is illustrated. Array 200 includes well group 202 (denoted by horizontal lines) and well group 204 (denoted by diagonal lines).

Each well in well group 202 has horizontal distance 230 from the adjacent well in well group 202. Each well in well group 202 has vertical distance 232 from the adjacent well in well group 202.

Each well in well group 204 has horizontal distance 236 from the adjacent well in well group 204. Each well in well group 204 has vertical distance 238 from the adjacent well in well group 204.

Each well in well group 202 is distance 234 from the adjacent wells in well group 204. Each well in well group 204 is distance 234 from the adjacent wells in well group 202.

In some embodiments, each well in well group 202 is surrounded by four wells in well group 204. In some embodiments, each well in well group 204 is surrounded by four wells in well group 202.

In some embodiments, horizontal distance 230 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, vertical distance 232 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, horizontal distance 236 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, vertical distance 238 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, distance 234 is from about 5 to about 1000 meters, or from about 10 to about 500 meters, or from about 20 to about 250 meters, or from about 30 to about 200 meters, or from about 50 to about 150 meters, or from about 90 to about 120 meters, or about 100 meters.

In some embodiments, array of wells 200 may have from about 10 to about 1000 wells, for example from about 5 to about 500 wells in well group 202, and from about 5 to about 500 wells in well group 204.

In some embodiments, array of wells 200 is seen as a top view with well group 202 and well group 204 being vertical wells spaced on a piece of land. In some embodiments, array of wells 200 is seen as a cross-sectional side view with well group 202 and well group 204 being horizontal wells spaced within a formation.

The recovery of oil and/or gas with array of wells 200 from an underground formation may be accomplished by any known method. Suitable methods include subsea production, surface production, primary, secondary, or tertiary production. The selection of the method used to recover the oil and/or gas from the underground formation is not critical.

In some embodiments, oil and/or gas may be recovered from a formation into a well, and flow through the well and flowline to a facility. In some embodiments, enhanced oil recovery, with the use of an agent for example steam, water, a surfactant, a polymer flood, and/or a miscible agent such as a carbon disulfide formulation or carbon dioxide, may be used to increase the flow of oil and/or gas from the formation.

In some embodiments, oil and/or gas recovered from a formation may include a sulfur compound. The sulfur compound may include hydrogen sulfide, mercaptans, sulfides and disulfides other than hydrogen disulfide, or heterocyclic sulfur compounds for example thiophenes, benzothiophenes, or substituted and condensed ring dibenzothiophenes, or mixtures thereof.

In some embodiments, a sulfur compound from the formation may be converted into a carbon disulfide formulation. The conversion of at least a portion of the sulfur compound into a carbon disulfide formulation may be accomplished by any known method. Suitable methods may include oxidation reaction of the sulfur compound to sulfur and/or sulfur dioxides, and by reaction of sulfur and/or sulfur dioxide with carbon and/or a carbon containing compound to form the carbon disulfide formulation. The selection of the method used to convert at least a portion of the sulfur compound into a carbon disulfide formulation is not critical.

In some embodiments, a suitable miscible enhanced oil recovery agent may be a carbon disulfide formulation. The carbon disulfide formulation may include carbon disulfide and/or carbon disulfide derivatives for example, thiocarbonates, xanthates and mixtures thereof; and optionally one or more of the following: hydrogen sulfide, sulfur, carbon dioxide, hydrocarbons, and mixtures thereof.

In some embodiments, a suitable method of producing a carbon disulfide formulation is disclosed in U.S. Pat. No. 7,426,959, having Ser. No. 11/409,436, filed on Apr. 19, 2006. U.S. Pat. No. 7,426,959 is herein incorporated by reference in its entirety.

Figure 2B:
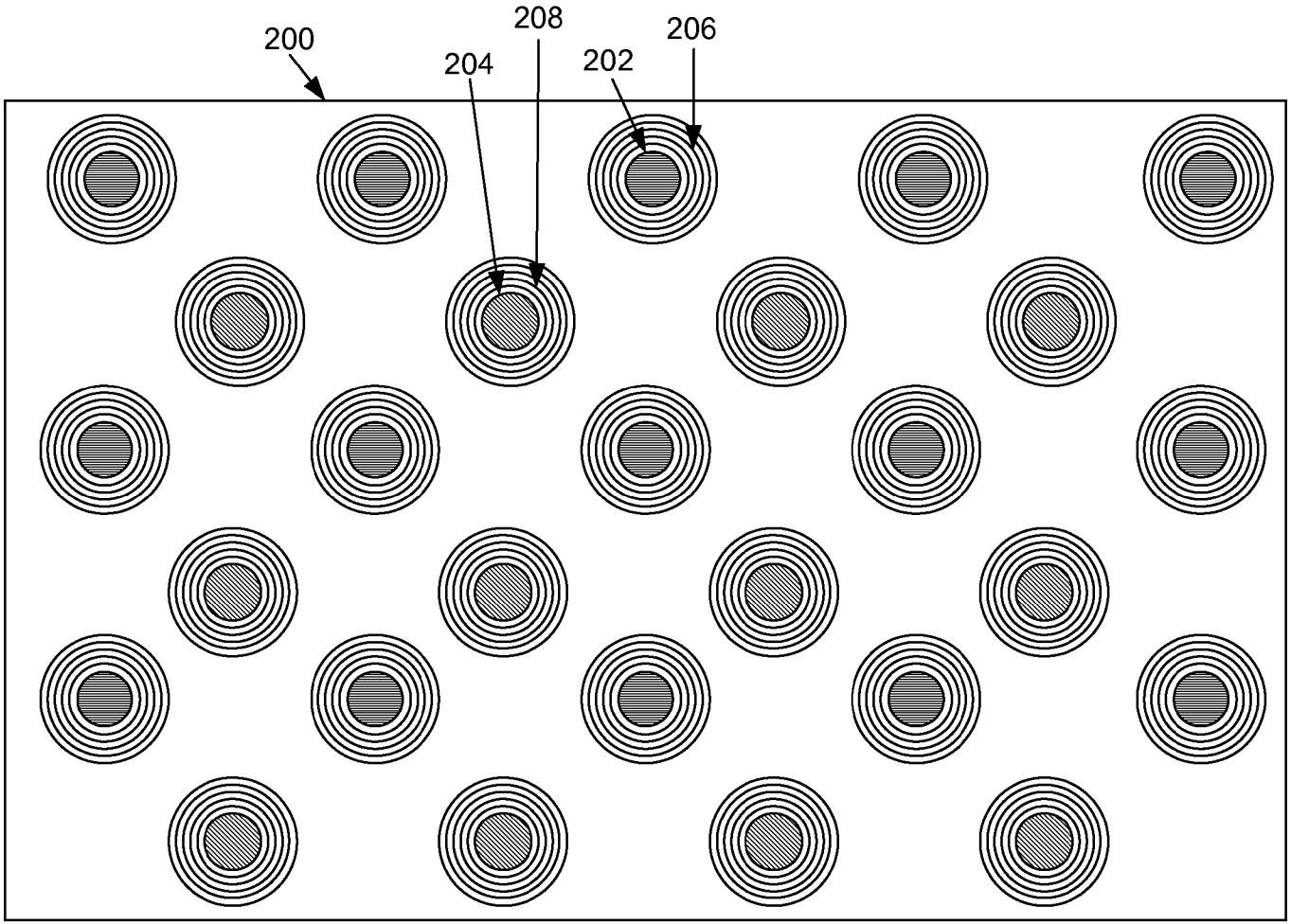
FIGS. 2*b* and 2*c* illustrate the well pattern of FIG. 2*a* during enhanced oil recovery processes.

Referring now to FIG. 2*b*, in some embodiments, array of wells 200 is illustrated. Array 200 includes well group 202 (denoted by horizontal lines) and well group 204 (denoted by diagonal lines).

In some embodiments, a miscible enhanced oil recovery agent is injected into well group 204, and oil is recovered from well group 202. As illustrated, the miscible enhanced oil recovery agent has injection profile 208, and oil recovery profile 206 is being produced to well group 202.

In some embodiments, a miscible enhanced oil recovery agent is injected into well group 202, and oil is recovered from well group 204. As illustrated, the miscible enhanced oil recovery agent has injection profile 206, and oil recovery profile 208 is being produced to well group 204.

In some embodiments, well group 202 may be used for injecting a miscible enhanced oil recovery agent, and well group 204 may be used for producing oil and/or gas from the formation for a first time period; then well group 204 may be used for injecting a miscible enhanced oil recovery agent, and well group 202 may be used for producing oil and/or gas from the formation for a second time period, where the first and second time periods comprise a cycle.

In some embodiments, multiple cycles may be conducted which include alternating well groups 202 and 204 between injecting a miscible enhanced oil recovery agent, and producing oil and/or gas from the formation, where one well group is injecting and the other is producing for a first time period, and then they are switched for a second time period.

In some embodiments, a cycle may be from about 12 hours to about 1 year, or from about 3 days to about 6 months, or from about 5 days to about 3 months. In some embodiments, each cycle may increase in time, for example each cycle may be from about 5% to about 10% longer than the previous cycle, for example about 8% longer.

In some embodiments, a miscible enhanced oil recovery agent or a mixture including a miscible enhanced oil recovery agent may be injected at the beginning of a cycle, and an immiscible enhanced oil recovery agent or a mixture including an immiscible enhanced oil recovery agent may be injected at the end of the cycle. In some embodiments, the beginning of a cycle may be the first 10% to about 80% of a cycle, or the first 20% to about 60% of a cycle, the first 25% to about 40% of a cycle, and the end may be the remainder of the cycle.

In some embodiments, suitable miscible enhanced oil recovery agents include carbon disulfide, hydrogen sulfide, carbon dioxide, octane, pentane, LPG, C2-C6 aliphatic hydrocarbons, nitrogen, diesel, mineral spirits, naptha solvent, asphalt solvent, kerosene, acetone, xylene, trichloroethane, or mixtures of two or more of the preceding, or other miscible enhanced oil recovery agents as are known in the art. In some embodiments, suitable miscible enhanced oil recovery agents are first contact miscible or multiple contact miscible with oil in the formation.

In some embodiments, suitable immiscible enhanced oil recovery agents include water in gas or liquid form, air, mixtures of two or more of the preceding, or other immiscible enhanced oil recovery agents as are known in the art. In some embodiments, suitable immiscible enhanced oil recovery agents are not first contact miscible or multiple contact miscible with oil in the formation.

In some embodiments, immiscible and/or miscible enhanced oil recovery agents injected into the formation may be recovered from the produced oil and/or gas and re-injected into the formation.

In some embodiments, oil as present in the formation prior to the injection of any enhanced oil recovery agents has a viscosity of at least about 100 centipoise, or at least about 500 centipoise, or at least about 1000 centipoise, or at least about 2000 centipoise, or at least about 5000 centipoise, or at least about 10,000 centipoise. In some embodiments, oil as present in the formation prior to the injection of any enhanced oil recovery agents has a viscosity of up to about 5,000,000 centipoise, or up to about 2,000,000 centipoise, or up to about 1,000,000 centipoise, or up to about 500,000 centipoise.

Figure 2C:
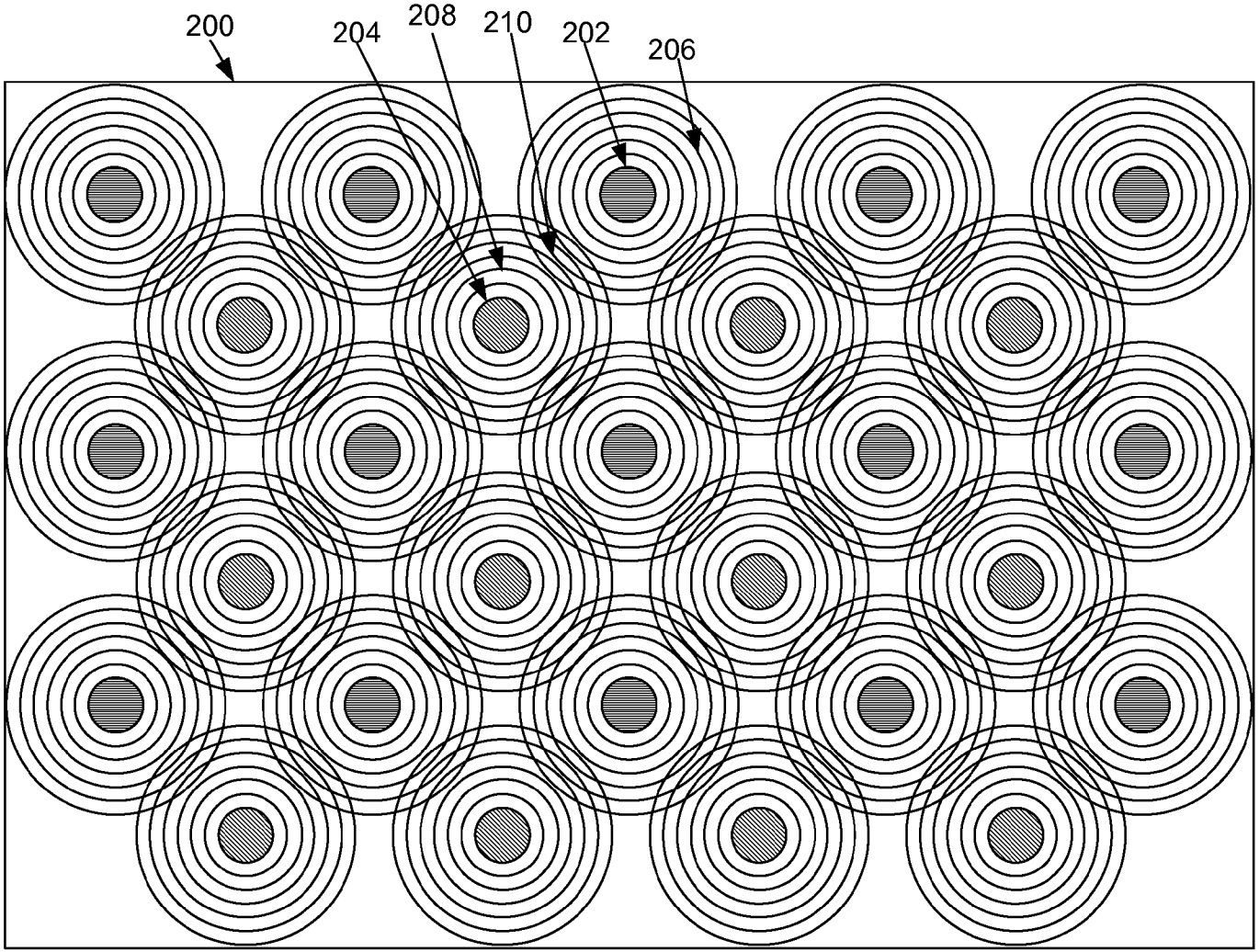

Referring now to FIG. 2*c*, in some embodiments, array of wells 200 is illustrated. Array 200 includes well group 202 (denoted by horizontal lines) and well group 204 (denoted by diagonal lines).

In some embodiments, a miscible enhanced oil recovery agent is injected into well group 204, and oil is recovered from well group 202. As illustrated, the miscible enhanced oil recovery agent has injection profile 208 with overlap 210 with oil recovery profile 206, which is being produced to well group 202.

In some embodiments, a miscible enhanced oil recovery agent is injected into well group 202, and oil is recovered from well group 204. As illustrated, the miscible enhanced oil recovery agent has injection profile 206 with overlap 210 with oil recovery profile 208, which is being produced to well group 204.

Releasing at least a portion of the miscible enhanced oil recovery agent and/or other liquids and/or gases may be accomplished by any known method. One suitable method is injecting the miscible enhanced oil recovery formulation into a single conduit in a single well, allowing carbon disulfide formulation to soak, and then pumping out at least a portion of the carbon disulfide formulation with gas and/or liquids. Another suitable method is injecting the miscible enhanced oil recovery formulation into a first well, and pumping out at least a portion of the miscible enhanced oil recovery formulation with gas and/or liquids through a second well. The selection of the method used to inject at least a portion of the miscible enhanced oil recovery formulation and/or other liquids and/or gases is not critical.

In some embodiments, the miscible enhanced oil recovery formulation and/or other liquids and/or gases may be pumped into a formation at a pressure up to the fracture pressure of the formation.

In some embodiments, the miscible enhanced oil recovery formulation may be mixed in with oil and/or gas in a formation to form a mixture which may be recovered from a well. In some embodiments, a quantity of the miscible enhanced oil recovery formulation may be injected into a well, followed by another component to force carbon the formulation across the formation. For example air, water in liquid or vapor form, carbon dioxide, other gases, other liquids, and/or mixtures thereof may be used to force the miscible enhanced oil recovery formulation across the formation.

In some embodiments, the miscible enhanced oil recovery formulation may be heated prior to being injected into the formation to lower the viscosity of fluids in the formation, for example heavy oils, paraffins, asphaltenes, etc.

In some embodiments, the miscible enhanced oil recovery formulation may be heated and/or boiled while within the formation, with the use of a heated fluid or a heater, to lower the viscosity of fluids in the formation. In some embodiments, heated water and/or steam may be used to heat and/or vaporize the miscible enhanced oil recovery formulation in the formation.

In some embodiments, the miscible enhanced oil recovery formulation may be heated and/or boiled while within the formation, with the use of a heater. One suitable heater is disclosed in copending U.S. patent application having Ser. No. 10/693,816, filed on Oct. 24, 2003. U.S. patent application having Ser. No. 10/693,816 is herein incorporated by reference in its entirety.

Figure 3A:
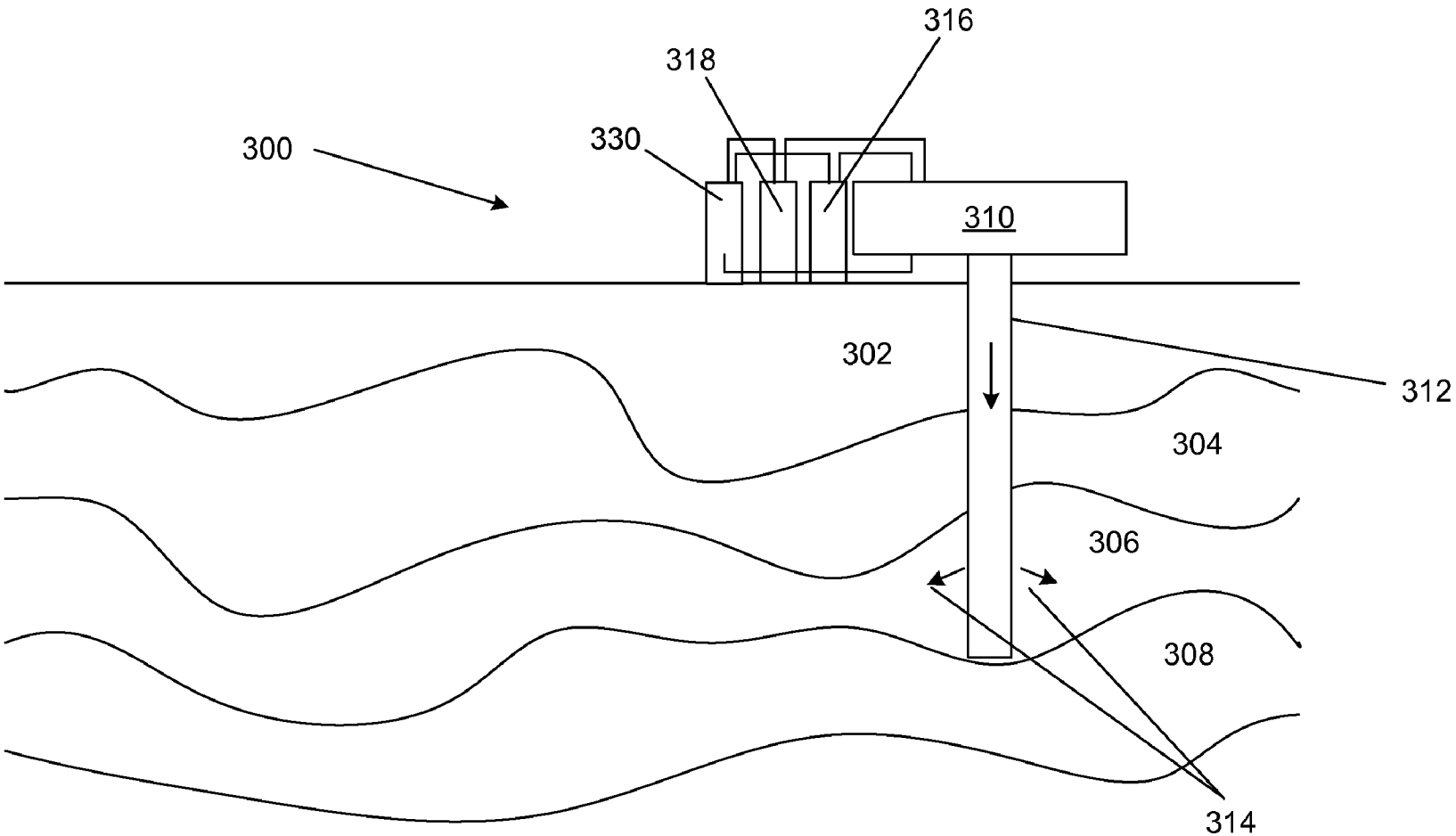
FIGS. 3*a*-3*c* illustrate oil and/or gas production systems.
Figure 3B:
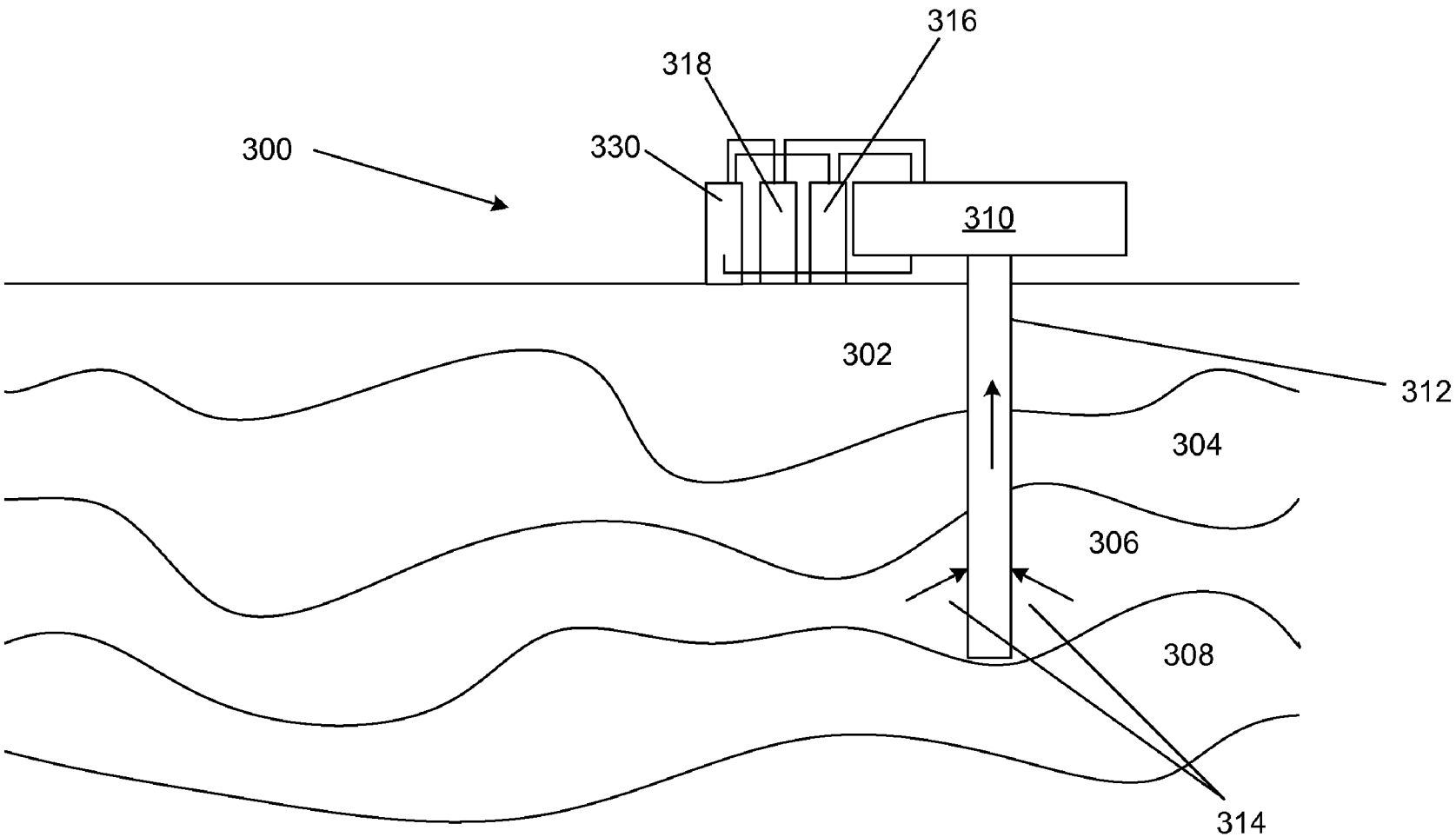

Referring now to FIGS. 3*a* and 3*b*, in some embodiments of the invention, system 300 is illustrated. System 300 includes underground formation 302, underground formation 304, underground formation 306, and underground formation 308. Facility 310 is provided at the surface. Well 312 traverses formations 302 and 304, and has openings in formation 306. Portions 314 of formation 306 may be optionally fractured and/or perforated. During primary production, oil and gas from formation 306 is produced into portions 314, into well 312, and travels up to facility 310. Facility 310 then separates gas, which is sent to gas processing 316, and liquid, which is sent to liquid storage 318. Facility 310 also includes miscible enhanced oil recovery formulation storage 330. As shown in FIG. 3*a*, miscible enhanced oil recovery formulation may be pumped down well 312 that is shown by the down arrow and pumped into formation 306. Miscible enhanced oil recovery formulation may be left to soak in formation for a period of time from about 1 hour to about 15 days, for example from about 5 to about 50 hours.

After the soaking period, as shown in FIG. 3*b*, miscible enhanced oil recovery formulation and oil and/or gas is then produced back up well 312 to facility 310. Facility 310 is adapted to separate and/or recycle miscible enhanced oil recovery formulation, for example by boiling the formulation, condensing it or filtering or reacting it, then re-injecting the formulation into well 312, for example by repeating the soaking cycle shown in FIGS. 3*a* and 3*b* from about 2 to about 5 times.

In some embodiments, miscible enhanced oil recovery formulation may be pumped into formation 306 below the fracture pressure of the formation, for example from about 40% to about 90% of the fracture pressure.

In some embodiments, well 312 as shown in FIG. 3*a* injecting into formation 306 may be representative of a well in well group 202, and well 312 as shown in FIG. 3*b* producing from formation 306 may be representative of a well in well group 204.

In some embodiments, well 312 as shown in FIG. 3*a* injecting into formation 306 may be representative of a well in well group 204, and well 312 as shown in FIG. 3*b* producing from formation 306 may be representative of a well in well group 202.

Figure 3C:
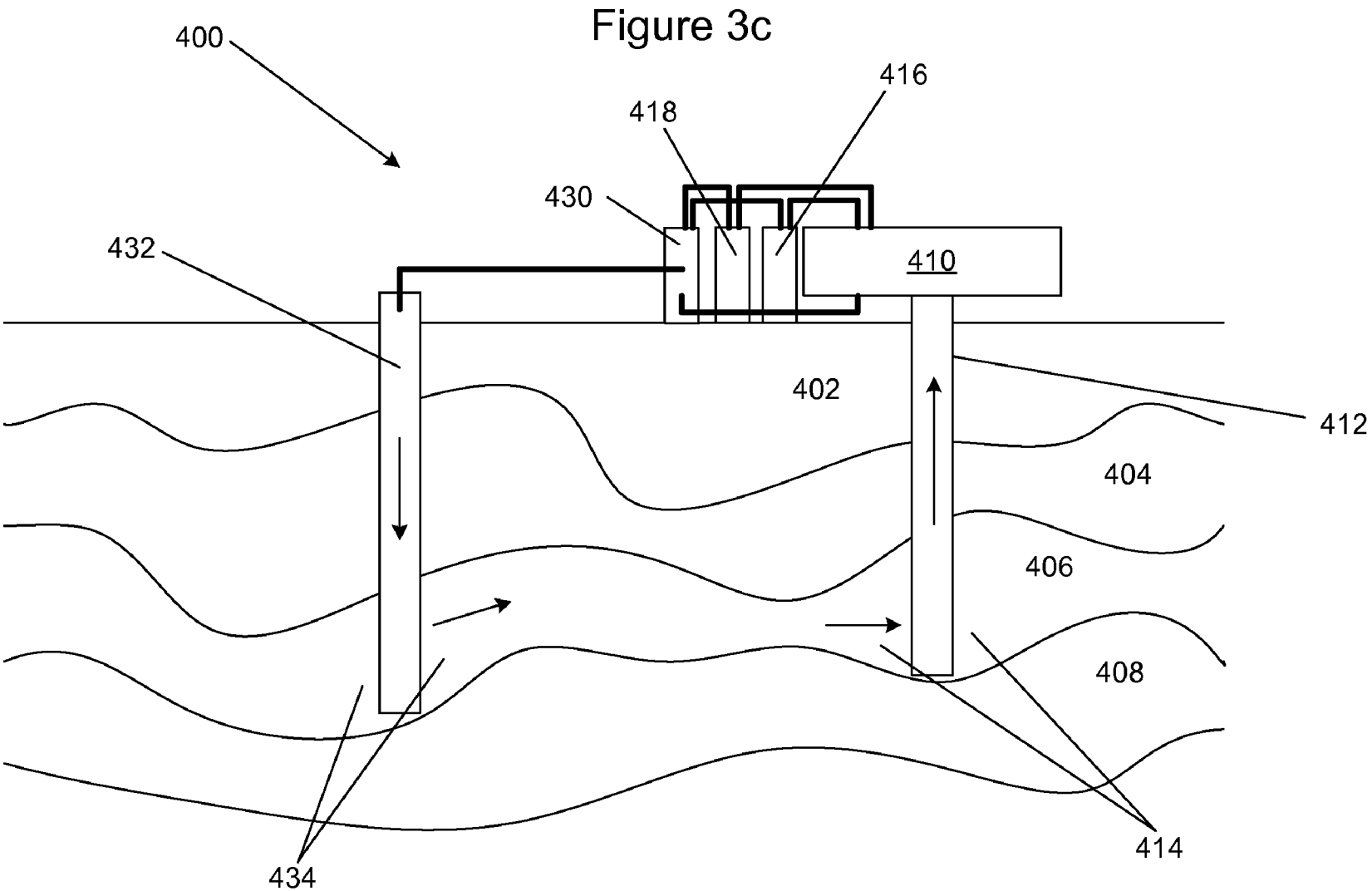

Referring now to FIG. 3*c*, in some embodiments of the invention, system 400 is illustrated. System 400 includes underground formation 402, formation 404, formation 406, and formation 408. Production facility 410 is provided at the surface. Well 412 traverses formation 402 and 404 has openings at formation 406. Portions of formation 414 may be optionally fractured and/or perforated. As oil and gas is produced from formation 406 it enters portions 414, and travels up well 412 to production facility 410. Gas and liquid may be separated, and gas may be sent to gas storage 416, and liquid may be sent to liquid storage 418. Production facility 410 is able to produce and/or store miscible enhanced oil recovery formulation, which may be produced and stored in production/storage 430. Hydrogen sulfide and/or other sulfur containing compounds from well 412 may be sent to miscible enhanced oil recovery formulation production/storage 430. Miscible enhanced oil recovery formulation is pumped down well 432, to portions 434 of formation 406. Miscible enhanced oil recovery formulation traverses formation 406 to aid in the production of oil and gas, and then the miscible enhanced oil recovery formulation, oil and/or gas may all be produced to well 412, to production facility 410. Miscible enhanced oil recovery formulation may then be recycled, for example by boiling the formulation, condensing it or filtering or reacting it, then re-injecting the formulation into well 432.

In some embodiments, a quantity of miscible enhanced oil recovery formulation or miscible enhanced oil recovery formulation mixed with other components may be injected into well 432, followed by another component to force miscible enhanced oil recovery formulation or miscible enhanced oil recovery formulation mixed with other components across formation 406, for example air; water in gas or liquid form; water mixed with one or more salts, polymers, and/or surfactants; carbon dioxide; other gases; other liquids; and/or mixtures thereof.

In some embodiments, well 412 which is producing oil and/or gas is representative of a well in well group 202, and well 432 which is being used to inject miscible enhanced oil recovery formulation is representative of a well in well group 204.

In some embodiments, well 412 which is producing oil and/or gas is representative of a well in well group 204, and well 432 which is being used to inject miscible enhanced oil recovery formulation is representative of a well in well group 202.

Figure 4:
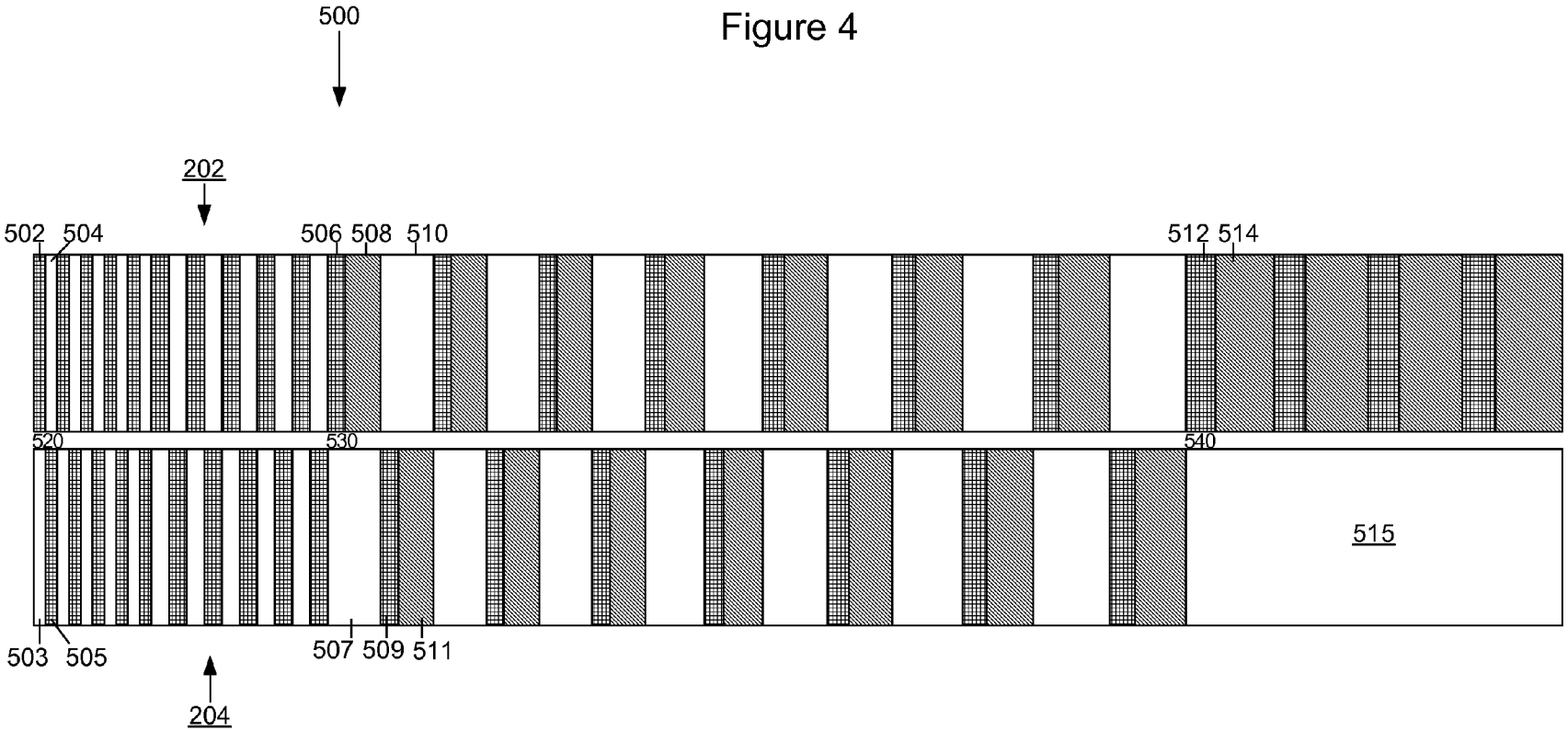
FIG. 4 illustrates an oil and/or gas production method.

Referring now to FIG. 4, in some embodiments of the invention, method 500 is illustrated. Method 500 includes injecting a miscible enhanced oil recovery formulation indicated by checkerboard pattern; injecting an immiscible enhanced oil recovery formulation indicated by diagonal pattern; and producing oil and/or gas from a formation indicated by white pattern.

Injection and production timing for well group 202 is shown by the top timeline, while injection and production timing for well group 204 is shown by the bottom timeline.

In some embodiments, at time 520, miscible enhanced oil recovery formulation is injected into well group 202 for time period 502, while oil and/or gas is produced from well group 204 for time period 503. Then, miscible enhanced oil recovery formulation is injected into well group 204 for time period 505, while oil and/or gas is produced from well group 202 for time period 504. This injection/production cycling for well groups 202 and 204 may be continued for a number of cycles, for example from about 5 to about 25 cycles.

In some embodiments, at time 530, there may be a cavity in the formation due to oil and/or gas that has been produced during time 520. During time 530, only the leading edge of cavity may be filled with a miscible enhanced oil recovery formulation, which is then pushed through the formation with an immiscible enhanced oil recovery formulation. Miscible enhanced oil recovery formulation may be injected into well group 202 for time period 506, then immiscible enhanced oil recovery formulation may be injected into well group 202 for time period 508, while oil and/or gas may be produced from well group 204 for time period 507. Then, miscible enhanced oil recovery formulation may be injected into well group 204 for time period 509, then immiscible enhanced oil recovery formulation may be injected into well group 204 for time period 511, while oil and/or gas may be produced from well group 202 for time period 510. This injection/production cycling for well groups 202 and 204 may be continued for a number of cycles, for example from about 5 to about 25 cycles.

In some embodiments, at time 540, there may be a significant hydraulic communication between well group 202 and well group 204. Miscible enhanced oil recovery formulation may be injected into well group 202 for time period 512, then immiscible enhanced oil recovery formulation may be injected into well group 202 for time period 514 while oil and/or gas may be produced from well group 204 for time period 515. The injection cycling of miscible and immiscible enhanced oil recovery formulations into well group 202 while producing oil and/or gas from well group 204 may be continued as long as desired, for example as long as oil and/or gas is produced from well group 204.

In some embodiments, periods 502, 503, 504, and/or 505 may be from about 6 hours to about 10 days, for example from about 12 hours to about 72 hours, or from about 24 hours to about 48 hours.

In some embodiments, each of periods 502, 503, 504, and/or 505 may increase in length from time 520 until time 530.

In some embodiments, each of periods 502, 503, 504, and/or 505 may continue from time 520 until time 530 for about 5 to about 25 cycles, for example from about 10 to about 15 cycles.

In some embodiments, period 506 is from about 10% to about 50% of the combined length of period 506 and period 508, for example from about 20% to about 40%, or from about 25% to about 33%.

In some embodiments, period 509 is from about 10% to about 50% of the combined length of period 509 and period 511, for example from about 20% to about 40%, or from about 25% to about 33%.

In some embodiments, the combined length of period 506 and period 508 is from about 2 days to about 21 days, for example from about 3 days to about 14 days, or from about 5 days to about 10 days.

In some embodiments, the combined length of period 509 and period 511 is from about 2 days to about 21 days, for example from about 3 days to about 14 days, or from about 5 days to about 10 days.

In some embodiments, the combined length of period 512 and period 514 is from about 2 days to about 21 days, for example from about 3 days to about 14 days, or from about 5 days to about 10 days.

In some embodiments, oil and/or gas produced may be transported to a refinery and/or a treatment facility. The oil and/or gas may be processed to produced to produce commercial products such as transportation fuels such as gasoline and diesel, heating fuel, lubricants, chemicals, and/or polymers. Processing may include distilling and/or fractionally distilling the oil and/or gas to produce one or more distillate fractions. In some embodiments, the oil and/or gas, and/or the one or more distillate fractions may be subjected to a process of one or more of the following: catalytic cracking, hydrocracking, hydrotreating, coking, thermal cracking, distilling, reforming, polymerization, isomerization, alkylation, blending, and dewaxing.

ILLUSTRATIVE EMBODIMENTS

In one embodiment of the invention, there is disclosed a system for producing oil and/or gas from an underground formation comprising a first array of wells dispersed above the formation; a second array of wells dispersed above the formation; wherein the first array of wells comprises a mechanism to inject a miscible enhanced oil recovery formulation into the formation while the second array of wells comprises a mechanism to produce oil and/or gas from the formation for a first time period; and wherein the second array of wells comprises a mechanism to inject a miscible enhanced oil recovery formulation into the formation while the first array of wells comprises a mechanism to produce oil and/or gas from the formation for a second time period. In some embodiments, a well in the first array of wells is at a distance of 10 meters to 1 kilometer from one or more adjacent wells in the second array of wells. In some embodiments, the underground formation is beneath a body of water. In some embodiments, the system also includes a mechanism for injecting an immiscible enhanced oil recovery formulation into the formation, after the miscible enhanced oil recovery formulation has been released into the formation. In some embodiments, the system also includes a miscible enhanced oil recovery formulation selected from the group consisting of a carbon disulfide formulation, hydrogen sulfide, carbon dioxide, octane, pentane, LPG, C2-C6 aliphatic hydrocarbons, nitrogen, diesel, mineral spirits, naptha solvent, asphalt solvent, kerosene, acetone, xylene, trichloroethane, and mixtures thereof. In some embodiments, the system also includes an immiscible enhanced oil recovery formulation selected from the group consisting of water in gas or liquid form, air, and mixtures thereof. In some embodiments, the first array of wells comprises from 5 to 500 wells, and the second array of wells comprises from 5 to 500 wells. In some embodiments, the system also includes a miscible enhanced oil recovery formulation comprising a carbon disulfide formulation. In some embodiments, the system also includes a mechanism for producing a carbon disulfide formulation. In some embodiments, the underground formation comprises an oil having a viscosity from 100 to 5,000,000 centipoise. In some embodiments, the first array of wells comprises a miscible enhanced oil recovery formulation profile in the formation, and the second array of wells comprises an oil recovery profile in the formation, the system further comprising an overlap between the miscible enhanced oil recovery formulation profile and the oil recovery profile.

In one embodiment of the invention, there is disclosed a method for producing oil and/or gas comprising injecting a carbon disulfide formulation into a formation for a first time period from a first well; and then injecting an immiscible enhanced oil recovery formulation into the formation for a second time period from the first well, to push the carbon disulfide formulation through the formation; and producing oil and/or gas from the formation from a second well. In some embodiments, the method also includes recovering carbon disulfide formulation from the oil and/or gas, if present, and then injecting at least a portion of the recovered carbon disulfide formulation into the formation. In some embodiments, injecting the carbon disulfide formulation comprises injecting at least a portion of the carbon disulfide formulation into the formation in a mixture with one or more of hydrocarbons; sulfur compounds other than carbon disulfide; carbon dioxide; carbon monoxide; or mixtures thereof. In some embodiments, the method also includes heating the carbon disulfide formulation prior to injecting the carbon disulfide formulation into the formation, or while within the formation. In some embodiments, the carbon disulfide formulation is injected at a pressure from 0 to 37,000 kilopascals above the initial reservoir pressure, measured prior to when carbon disulfide injection begins. In some embodiments, the underground formation comprises a permeability from 0.0001 to 15 Darcies, for example a permeability from 0.001 to 1 Darcy. In some embodiments, any oil, as present in the underground formation prior to the injecting the carbon disulfide formulation, has a sulfur content from 0.5% to 5%, for example from 1% to 3%. In some embodiments, the method also includes converting at least a portion of the recovered oil and/or gas into a material selected from the group consisting of transportation fuels such as gasoline and diesel, heating fuel, lubricants, chemicals, and/or polymers.

In one embodiment of the invention, there is disclosed a method for producing oil and/or gas comprising injecting a miscible enhanced oil recovery formulation into a formation for a first time period from a first well; producing oil and/or gas from the formation from a second well for the first time period; injecting a miscible enhanced oil recovery formulation into a formation for a second time period from the second well; and producing oil and/or gas from the formation from the first well for the second time period. In some embodiments, the first and second time period comprise a cycle, the cycle from 12 hours to 1 year. In some embodiments, the method also includes injecting an immiscible enhanced oil recovery formulation into the formation for a time period after the first time period and prior to the second time period from the first well, to push the miscible enhanced oil recovery formulation through the formation. In some embodiments, the method also includes injecting an immiscible enhanced oil recovery formulation into the formation for a time period after the second time period from the second well, to push the miscible enhanced oil recovery formulation through the formation. In some embodiments, the produced oil and/or gas comprises a sulfur compound, further comprising converting the sulfur compound into a miscible enhanced oil recovery formulation. In some embodiments, the miscible enhanced oil recovery formulation comprises a carbon disulfide formulation. In some embodiments, the method also includes heating the miscible enhanced oil recovery formulation, for example with a heater in the formation.

Those of skill in the art will appreciate that many modifications and variations are possible in terms of the disclosed embodiments of the invention, configurations, materials and methods without departing from their spirit and scope. Accordingly, the scope of the claims appended hereafter and their functional equivalents should not be limited by particular embodiments described and illustrated herein, as these are merely exemplary in nature.

The invention claimed is:

1. A system for producing oil or gas from an underground formation comprising:

a first array of wells dispersed above the formation;

a second array of wells dispersed above the formation;

a miscible solvent comprising a carbon disulfide formulation;

wherein the first array of wells comprises a pump to inject the miscible solvent into the formation while the second array of wells comprises a pump to produce oil or gas from the formation for a first time period; and wherein the second array of wells comprises a pump to inject the miscible solvent into the formation while the first array of wells comprises a pump to produce oil or gas from the formation for a second time period.

2. The system of claim 1, wherein a well in the first array of wells is at a distance of 10 meters to 1 kilometer from one or more adjacent wells in the second array of wells.

3. The system of claim 1, wherein the underground formation is beneath a body of water.

4. The system of claim 1, wherein the first array of wells further comprises a pump for injecting an immiscible enhanced oil recovery formulation into the formation after the miscible solvent has been released into the formation.

5. The system of claim 1, further comprising an immiscible enhanced oil recovery formulation selected from the group consisting of water in gas or liquid form, air, and mixtures thereof.

6. The system of claim 1, wherein the first array of wells comprises from 5 to 500 wells, and the second array of wells comprises from 5 to 500 wells.

7. The system of claim 1, further comprising a reactor for producing a carbon disulfide formulation.

8. The system of claim 1, wherein the underground formation comprises an oil having a viscosity from 100 to 5,000,000 centipoise.

9. The system of claim 1, wherein the first array of wells comprises a miscible solvent profile in the formation, and the second array of wells comprises an oil recovery profile in the formation, the system further comprising an overlap between the miscible solvent profile and the oil recovery profile.

10. The system of claim 1, wherein the second array of wells further comprises a pump for injecting an immiscible enhanced oil recovery formulation into the formation after the miscible solvent has been released into the formation.

11. A method for producing oil or gas comprising:

injecting a miscible solvent comprising a carbon disulfide formulation into a formation for a first time period from a first well;

producing oil or gas from the formation from a second well for the first time period;

injecting the miscible solvent into the formation for a second time period from the second well; and producing oil or gas from the formation from the first well for the second time period.

12. The method of claim 11, wherein the first and second time period comprise a cycle, the cycle from 12 hours to 1 year.

13. The method of claim 11, further comprising:

injecting an immiscible enhanced oil recovery formulation into the formation for a time period after the first time period and prior to the second time period from the first well, to push the miscible solvent through the formation.

14. The method of claim 11, further comprising:

injecting an immiscible enhanced oil recovery formulation into the formation for a time period after the second time period from the second well, to push the miscible solvent through the formation.

15. The method of claim 11, wherein the produced oil or gas comprises a sulfur compound, further comprising converting the sulfur compound into the miscible solvent.

16. The method of claim 11, further comprising heating the miscible solvent.

* * * * *